US011612230B2

(12) United States Patent
Cho et al.

(10) Patent No.: US 11,612,230 B2
(45) Date of Patent: Mar. 28, 2023

(54) SHAPING METHOD OF SOLID COSMETIC MATERIAL AND SOLID COSMETIC CONTAINER FILLED WITH SOLID COSMETIC MATERIAL

(71) Applicant: COSMECCA KOREA Co., Ltd., Chungcheongbuk-do (KR)

(72) Inventors: Hyun Dae Cho, Chungcheongbuk-do (KR); Hong Seok Son, Gyeonggi-do (KR); Da Seul Kim, Gyeonggi-do (KR); Hye Jin Kim, Gyeonggi-do (KR)

(73) Assignee: COSMECCA KOREA CO., LTD., Chungcheongbuk-Do (KR)

( * ) Notice: Subject to any disclaimer, the term of this patent is extended or adjusted under 35 U.S.C. 154(b) by 371 days.

(21) Appl. No.: 16/854,952

(22) Filed: Apr. 22, 2020

(65) Prior Publication Data

US 2021/0059383 A1 Mar. 4, 2021

(30) Foreign Application Priority Data

Sep. 3, 2019 (KR) ..... 10-2019-0108864

(51) Int. Cl.

| | |
|---|---|
| ***A45D 40/06*** | (2006.01) |
| ***A45D 33/00*** | (2006.01) |
| ***A45D 33/02*** | (2006.01) |
| ***A45D 33/04*** | (2006.01) |
| ***A45D 40/16*** | (2006.01) |
| ***B30B 11/04*** | (2006.01) |

(52) U.S. Cl.

CPC ..... *A45D 40/06* (2013.01); *A45D 33/006* (2013.01); *B30B 11/04* (2013.01); *A45D 33/02* (2013.01); *A45D 33/04* (2013.01); *A45D 40/16* (2013.01)

(58) Field of Classification Search

CPC ..... A45D 33/006; A45D 40/06; A45D 33/02; A45D 33/04; A45D 40/00; A45D 40/10; A45D 40/16; A45D 40/24; A45D 2040/00; B30B 11/04; B30B 11/08; B30B 11/12; B29C 32/00; B29C 39/04; B29C 67/003; B65B 3/04; B65B 3/08; B65B 3/26

See application file for complete search history.

(56) References Cited

U.S. PATENT DOCUMENTS

| | | | | |
|---|---|---|---|---|
| 4,740,097 A * | 4/1988 | Kapustin | ..... | A45D 40/06 401/35 |
| 6,058,942 A * | 5/2000 | Eng | ..... | A45D 33/00 132/200 |
| 2002/0041788 A1* | 4/2002 | Look | ..... | A61K 8/31 401/55 |

FOREIGN PATENT DOCUMENTS

KR 20-0404009 Y1 12/2005

* cited by examiner

*Primary Examiner* — David J Walczak
(74) *Attorney, Agent, or Firm* — Bacon & Thomas, PLLC

(57) ABSTRACT

A shaping method of a solid cosmetic material and a solid cosmetic container filled with the solid cosmetic material, in which a solid cosmetic material used by grinding an upper surface thereof is solidified to fill an inner container of a cosmetic container with an extra space so that the solid cosmetic material does not come into close contact with an inner surface of the inner container of the cosmetic container, a cosmetic material plate on which the cosmetic material is seated is smoothly guided in an up-down direction, and the upper surface of the solid cosmetic material is smoothly cut as a portion of the cosmetic container is rotated so that the solid cosmetic material is discharged by a predetermined amount. An upper surface of the cosmetic material is maintained flat.

34 Claims, 7 Drawing Sheets

SHAPING METHOD OF SOLID COSMETIC MATERIAL AND SOLID COSMETIC CONTAINER FILLED WITH SOLID COSMETIC MATERIAL

CROSS REFERENCE TO RELATED APPLICATION

The present application claims the benefit of Korean Application 10-2019-0108864, filed Sep. 3, 2019, which is incorporated herein by reference.

FIELD OF THE INVENTION

The present invention relates to a shaping method of a solid cosmetic material and a solid cosmetic container filled with the solid cosmetic material, and more particularly, to a shaping method of a solid cosmetic material and a solid cosmetic container filled with the solid cosmetic material in which a solid cosmetic material used by grinding an upper surface thereof is solidified to fill an inner container of a cosmetic container with an extra space so that the solid cosmetic material does not come into close contact with an inner surface of the inner container of the cosmetic container, a cosmetic material plate on which the cosmetic material is seated is smoothly guided in an up-down direction, and the upper surface of the solid cosmetic material is smoothly cut as a portion of the cosmetic container is rotated so that the solid cosmetic material is discharged by a predetermined amount.

BACKGROUND OF THE INVENTION

Cosmetics largely include a cosmetic material impregnated with a cosmetic ingredient and a cosmetic material container for storing the cosmetic material. In general, cosmetics require convenience, safety, usability, hygiene, or the like, and a configuration of the cosmetic container is changed to satisfy the requirements according to a formulation of the cosmetic material. In addition, typically, the cosmetic material is manufactured and used in a solid, liquid, or gel form, and cosmetic containers are also variously manufactured according to the formulation of the cosmetic material and a method of using the cosmetic material.

In a solid cosmetic container of the related art, a user applies a solid cosmetic material formed in an inner container to a puff and applies the puff to a skin. However, there is an inconvenience that the user repeatedly touches the puff so as to apply the cosmetic material to the puff and an upper portion of the cosmetic material is open which is vulnerable to a long-term storage and hygiene. Moreover, it is not easy to adjust an amount of the used solid cosmetic material, and thus, it is difficult to prevent waste of the cosmetic material. Accordingly, there is a limit to using a certain amount or a small amount.

In addition, since the solid cosmetic material is used by compressing powder or kneading and solidifying the powder, the solid cosmetic material can use the cosmetic container of the related art. However, a solid cosmetic material having wax is easily removed from the inner container of the cosmetic container by an external force, and thus, there is a limitation to apply the cosmetic container of the related art to the solid cosmetic material having wax.

Korean Registered Utility Model No. 20-0404009 discloses a powder container in which a solid cosmetic material is scrapped off to be used when rotated in one direction in the powder container. However, in the related art, the cosmetic material is rotated only in one direction in the powder container constituted of a gear. Accordingly, there is a problem that the cosmetic material is scrapped in a step shape according to a movement of the gear. Accordingly, if a surface of the cosmetic material is uneven, there is a problem that, when the cosmetic material is rotated in one direction later, the cosmetic material is not discharged as much as the desired amount due to the uneven surface of the upper surface of the cosmetic material.

Moreover, in a method of the related art for filling the cosmetic container with the solid cosmetic material having wax, a cosmetic material bulk is melted at a high temperature so as to be a liquid, and thereafter, the liquid cosmetic material is putted in the cosmetic material inner container to be solidified. However, while the cosmetic material is solidified, the cosmetic material adheres to a wall surface of the inner container. As a result, the cosmetic material cannot be moved upward along the wall surface of the inner container of the cosmetic container, and the cosmetic material cannot be moved upward according to a rotation of a rotation grinder. Accordingly, the rotation grinder runs idle, and thus, there is a problem that the cosmetic material cannot be discharged.

PRIOR ART DOCUMENT

Patent Document

Korean Utility Model registration No. 20-0404009

SUMMARY OF THE INVENTION

The present invention is made in consideration of the above-described problems, and an object thereof is to form an extra space between an inner surface of an inner container and a side surface of a solidified cosmetic material using a filling guide member when a cosmetic container is filled with a solid cosmetic material and the solid cosmetic material solidified such that the cosmetic material does not adhere to the inner container of the cosmetic container and can be smoothly discharged.

Another object of the present invention is to keep an upper surface of the cosmetic material flat when the upper surface of the cosmetic material is cut according to a rotation of a grinder and to seat a portion of the cosmetic material pushed to an outside while being cutting maintain in the extra space. Accordingly, the upper surface of the cosmetic material can be maintained to be smoother.

Still another object of the present invention is to constitute a cutting blade so as to easily perform a rotation cutting such that uneven scrapping or imprint of the cosmetic material is prevented and the cosmetic material is normally scrapped and discharged during a later use.

Still another object of the present invention is to maintain equilibrium of a cosmetic material plate even during the operation of the plate so as to ensure that the upper surface of the cosmetic material is evenly cut to discharge the desired amount of cosmetic material.

Still another object of the present invention is to easily apply the discharged cosmetic material to the puff and to prevent the upper portion of the cosmetic material from opening so as to enable a long-term storage and a hygienic use.

In order to achieve the objects, according to an aspect, there is provided a method of shaping a solid cosmetic material in a cosmetic container. The method includes:

placing a filling guide member 70 on a cosmetic material plate 30 provided inside a cosmetic inner container 10 of the cosmetic container; filling the cosmetic material in the filling guide member 70 and solidifying the cosmetic material; and forming an extra space between an inner surface of the cosmetic inner container 10 and a side surface of the solidified cosmetic material.

According another aspect of the present invention, there is provided a method of shaping a solid cosmetic material in a cosmetic container. The method includes: (a) a step of preparing a cosmetic inner container 10 to which the cosmetic material is to be input; (b) a step of placing a filling guide member 70 on a cosmetic material plate 30 provided inside the cosmetic inner container 10; (c) a step of filling the cosmetic material in the filling guide member 70 and solidifying the cosmetic material; and (d) a step of removing the filling guide member 70 and forming an extra space between an inner surface of the cosmetic inner container 10 and a side surface of the solidified cosmetic material.

In the shaping method of solid cosmetic material according to the present invention, the placing of the filling guide member 70 may include (b-1) a step of screwing a plate shaft 20 to the cosmetic material plate 30, (b-2) a step of placing the cosmetic material plate 30 coupled to the plate shaft 20 on a bottom of the cosmetic inner container 10, and (b-3) a step of placing the filling guide member 70 so that an upper edge of the cosmetic material plate 30 comes into close contact with the inner surface of the cosmetic inner container 10.

In the shaping method of solid cosmetic material according to the present invention, the (b-2) step may include coupling at least one guide groove formed on an outer surface of the cosmetic material plate 30 to a least one protrusion guide formed on the inner surface of the cosmetic inner container 10 so that the guide groove is restrained by the protrusion guide.

In the shaping method of solid cosmetic material according to the present invention, the filling guide member 70 may have a hollow tubular shape in which a flange is formed on an outer side of an upper portion and have a diameter so as to come into close contact with the inner surface of the cosmetic inner container 10.

In the shaping method of solid cosmetic material according to the present invention, the filling guide member 70 have an inner surface which comes into contact with the cosmetic material and is anodized or is treated with a silicon release agent.

In the shaping method of solid cosmetic material according to the present invention, in the forming of the extra space, the filling guide member 70 may be removed to form an extra space C equal to a thickness of the filling guide member 70 between the inner surface of the cosmetic inner container 10 and the side surface of the cosmetic material.

In the shaping method of solid cosmetic material according to the present invention, in the forming of the extra space, the cosmetic material pushed during cutting of the cosmetic material or the cosmetic material pushed by a flat bottom surface of a grinder 40 may drop to be seated.

In the shaping method of solid cosmetic material according to the present invention, a grinder 40 may be coupled to an upper portion of the cosmetic inner container 10, the grinder 40 may be fitting-coupled to a plate shaft 20, and a bottom surface of the grinder 40 may be placed on an upper surface of the cosmetic material.

According to still another aspect of the present invention, there is provided a cosmetic container which is filled with the cosmetic material according to the present invention. The cosmetic container includes: a cosmetic inner container 10; a plate shaft 20 which is placed on an inner bottom surface of the cosmetic inner container 10; a cosmetic material plate 30 which is coupled to the plate shaft 20 and on which a cosmetic material P is seated; and a grinder 40 which rotates the plate shaft 20, is coupled to the cosmetic material plate 30 so that the cosmetic material plate 30 moves in an up-down direction, and is placed to cut an upper surface of the cosmetic material P while being rotated.

In the cosmetic container according to the present invention, the cosmetic inner container 10 may be formed to include an accommodation portion of which an upper portion is open and in which the cosmetic material P is accommodated, and may include a side surface having a first side surface 11 and a second side surface 12 which are sequentially separated at a predetermined interval from an inside toward an outside with a step.

In the cosmetic container according to the present invention, a plurality of first protrusion guides 11*a* may be formed on an inner surface of the first side surface 11 so as to protrude in the up-down direction.

In the cosmetic container according to the present invention, a guide wall 15 having a predetermined height may be formed to have a predetermined inner diameter at a center of a bottom surface of the accommodation portion, and a second protrusion guide 15*a* may be formed on the inner surface of a guide wall 15 in the up-down direction.

In the cosmetic container according to the present invention, the plate shaft 20 may include a rotary plate 21 having a predetermined size and a rotary rod 22 which is vertically formed integrally with the rotary plate 21 at a center of the rotary plate 21.

In the cosmetic container according to the present invention, the rotary rod 22 may include a rod penetrating hole 22*a* which has a polygonal cross section and is formed in the up-down direction.

In the cosmetic container according to the present invention, a shaft 44 of the grinder 40 may be fitted into the rod penetrating hole 22*a* such that the plate shaft 20 is rotated by the rotation of the grinder 40.

In the cosmetic container according to the present invention, threads may be formed on an outer surface of the rotary rod 22.

In the cosmetic container according to the present invention, the cosmetic material plate 30 may include a plate upper surface 31 on which the cosmetic material P is seated, a plate side surface 32 which is formed to be bent downward from an edge of the plate upper surface 31 and has a predetermined height, and a shaft coupling portion 33 which is formed downward to communicate with a coupling penetrating hole formed at a center of the plate upper surface 31 and has threads formed inside the shaft coupling portion 33.

In the cosmetic container according to the present invention, the shaft coupling portion 33 may be screwed to the rotary rod 22 of the plate shaft 20.

In the cosmetic container according to the present invention, the plate side surface 32 may include a plurality of first guide grooves 32*a* which are restrained by first protrusion guides 11*a* of the cosmetic inner container 10 and are guided in the up-down direction.

In the cosmetic container according to the present invention, a guide groove wall having a predetermined height may be annularly formed on a lower portion of the cosmetic material plate 30, and a plurality of second guide grooves 35*a* may be formed on an outer surface of the guide groove wall 35 in the up-down direction.

In the cosmetic container according to the present invention, an inner diameter of the guide groove wall 35 may be less than or equal to an inner diameter of a guide wall 15 formed on a bottom surface of the cosmetic inner container 10.

In the cosmetic container according to the present invention, a height of the guide groove wall 35 may be lower than or equal to a height of a plate side surface 32 of the cosmetic material plate 30.

In the cosmetic container according to the present invention, an inner diameter of the guide groove wall 35 may be larger than a diameter of a rotary plate 21 of the plate shaft 20.

In the cosmetic container according to the present invention, the grinder 40 may include a grinder upper surface 41 which is formed in a well shape having an edge protruding upward and a flat bottom and includes a plurality of discharge grooves 41*a* formed on a bottom surface, a grinder side surface 42 which is bent to have a predetermined height downward from the edge of the grinder upper surface 41 and includes an annular groove 42*a* formed on an outer surface edge, an annular sealing portion 43 which is formed to have a predetermined height and a predetermined inner diameter on a lower portion of the grinder upper surface 41, and a shaft 44 which is formed integrally with a lower surface at a center of a lower portion of the grinder 40 and has a polygonal cross section.

In the cosmetic container according to the present invention, a cutting blade 41*b* protruding to have a predetermined height along the discharge groove 41*a* may be formed on a slit side of one side of a lower portion of the discharge groove 41*a*.

In the cosmetic container according to the present invention, a length of the discharge groove 41*a* may be larger than a radius of the cosmetic material seated on the cosmetic material plate 30.

In the cosmetic container according to the present invention, the discharge groove 41*a* may be located in front of the cutting blade 41*b* in a rotation direction of the grinder 40 so that the cut cosmetic material is discharged.

In the cosmetic container according to the present invention, at least one discharge groove 41*a* is provided, and sizes or intervals of the discharge grooves 41*a* are equal to each other or are different from each other.

In the cosmetic container according to the present invention, at least one cutting blade 41*b* may be provided, and size or intervals the cutting blades 41*b* are equal to each other or are different from each other.

In the cosmetic container according to the present invention, the cutting blade 41*b* may be obliquely formed so that a downward end of the cutting blade 41*b* has a predetermined forward inclination.

In the cosmetic container according to the present invention, the cutting blade 41*b* may have a right triangle shape of which a downward end extends vertically and has an angle of 45°.

In the cosmetic container according to the present invention, an annular groove 42*a* may be formed on an inner surface edge of the grinder side surface 42 and may be fitting-coupled to an annular protrusion 13 which is formed on an outer upper edge of a second side surface 12 of the cosmetic inner container 10.

In the cosmetic container according to the present invention, the cosmetic container may further include an equilibrium maintaining means for maintaining an equilibrium of the cosmetic material plate 30.

In the cosmetic container according to the present invention, the equilibrium maintaining means may be a first equilibrium maintaining means 610 in which a plurality of compressed elastic bodies are radially arranged at a predetermined distance with respect to a central axis of the cosmetic material plate 30.

In the cosmetic container according to the present invention, in the first equilibrium maintaining means 610, a front end of each elastic body S may be fixed to be restrained at a predetermined position of a lower surface of the cosmetic material plate 30, and a rear end of each elastic body S may be fixed to be restrained at a position corresponding to a bottom surface of the cosmetic inner container 10.

In the cosmetic container according to the present invention, the equilibrium maintaining means may be a second equilibrium maintaining means 620 in which a plurality of gears are operated in conjunction with each other.

In the cosmetic container according to the present invention, the second equilibrium maintaining means 620 may include a plate shaft 200 which includes a rotary plate 210 which is coupled to a shaft coupling portion 330 formed at a center of the cosmetic material plate 30 and has a tooth shape, and a rotary rod 220 which is formed to have an angle of 90° at a center of the rotary plate 210, a plurality of gears 621 which includes an interlocking rotary plate 621*a* which meshes with the rotary plate 210 so as to be rotated and has a tooth shape and an interlocking rotary rod 621*b* which is formed at an angle of 90° at a center of the interlocking rotary plate 621*a* and has an outer surface on which threads are formed, and a plurality of nut-type interlocking shaft coupling portions 622 which are formed downward at a predetermined position of a lower surface of the cosmetic material plate 30 and are screwed to the interlocking rotary rod 621*b*.

According to still another aspect of the present invention, there is provided a method of shaping a solid cosmetic material in a cosmetic container. The method includes: (a) a step of placing a filling guide member 70 on a cosmetic material plate 30; (b) a step of filling the cosmetic material in the filling guide member 70 and solidifying the cosmetic material; (c) a step of removing the filling guide member 70; and (d) a step of coupling the cosmetic material plate 30 on which the cosmetic material is seated to an inside of the inner container 10 and forming an extra space between an inner surface of the cosmetic inner container 10 and a side surface of the solidified cosmetic material.

According to the present invention, an extra space between an inner surface of an inner container and a side surface of a solidified cosmetic material using a filling guide member when a cosmetic container is filled with a solid cosmetic material and the solid cosmetic material solidified, and thus, the cosmetic material does not adhere to the inner container of the cosmetic container and can be smoothly discharged.

Moreover, it is possible to keep an upper surface of the cosmetic material flat when the upper surface of the cosmetic material is cut according to a rotation of a grinder and to seat a portion of the cosmetic material pushed to an outside while being cutting maintain in the extra space, and thus, the upper surface of the cosmetic material can be maintained to be smoother.

In addition, a cutting blade is constituted so as to easily perform a rotation cutting. Accordingly, uneven scrapping or imprint of the cosmetic material is prevented and the cosmetic material is normally scrapped and discharged during a later use.

Moreover, it is possible to maintain equilibrium of a cosmetic material plate even during the operation of the plate so as to ensure that the upper surface of the cosmetic material is evenly cut to discharge the desired amount of cosmetic material.

In addition, it is possible to easily apply the discharged cosmetic material to the puff and to prevent the upper portion of the cosmetic material from opening so as to enable a long-term storage and a hygienic use.

Moreover, the present invention can be also applied to a solid cosmetic material having wax, as well as a solid cosmetic material obtained by compressing powder or kneading or solidifying the powder.

DETAILED DESCRIPTION OF THE INVENTION

Figure 1:
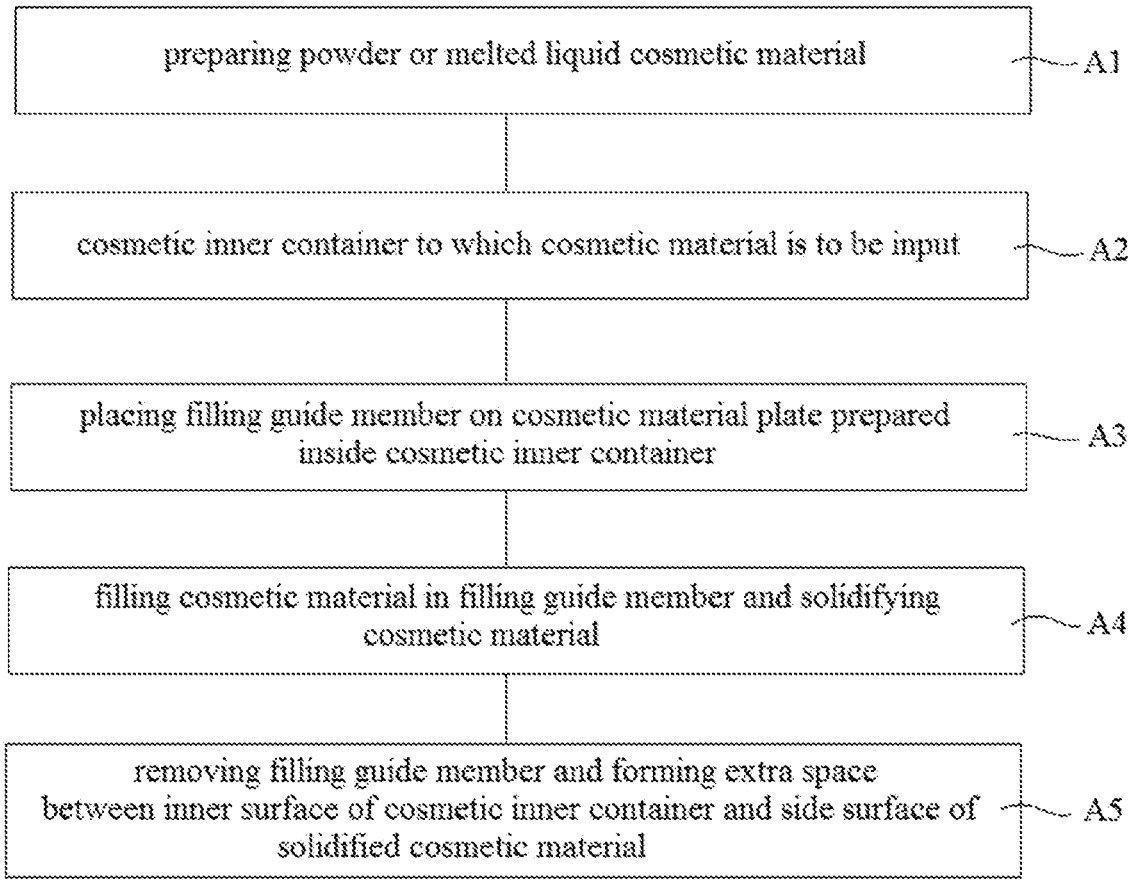
FIG. 1 is a flowchart illustrating a method of shaping a solid cosmetic material according to an embodiment of the present invention.

Hereinafter, exemplary embodiments of the present invention will be described in detail with reference to the accompanying drawings. The embodiments of the present invention can be modified in various forms, and the scope of the present invention should not be construed as being limited to the embodiments described below. The embodiments are provided to explain in detail the present invention to a person skilled in the art. Therefore, a shape of each element illustrated in the drawings may be exaggerated to emphasize a clear description.

Figure 2:
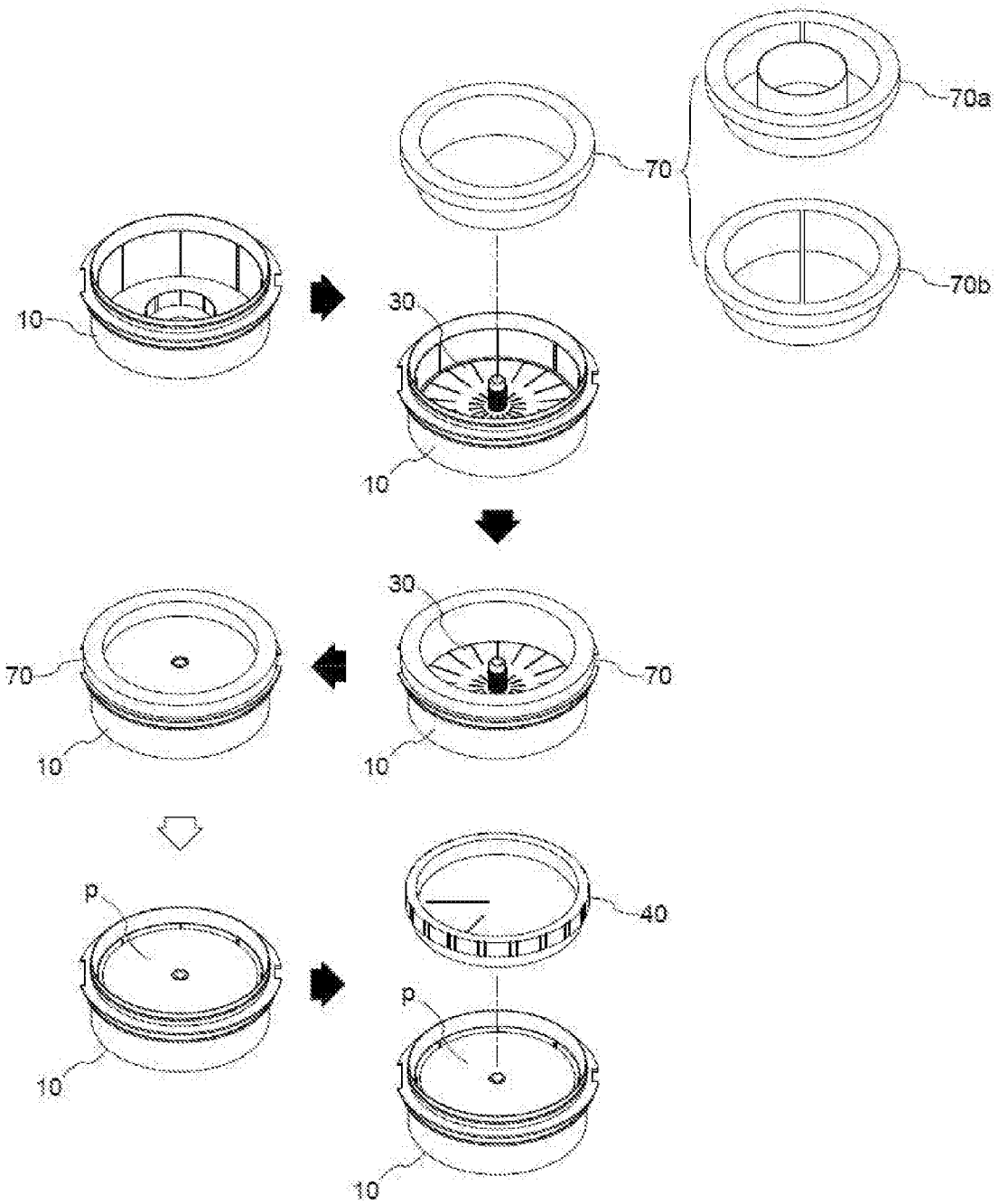
FIG. 2 is a view illustrating a filling guide member and a cosmetic material shaping method according to an embodiment of the present invention.
Figure 3:
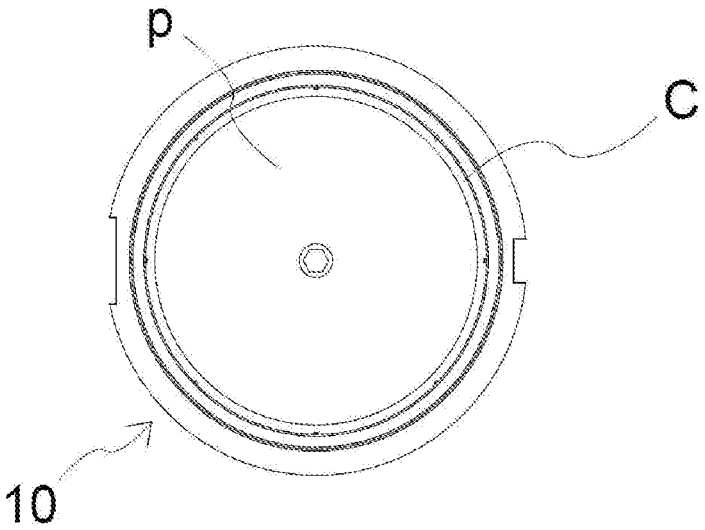
FIG. 3 is a plan view illustrating a cosmetic container on which the solid cosmetic material is seated according to an embodiment of the present invention.
Figure 4:
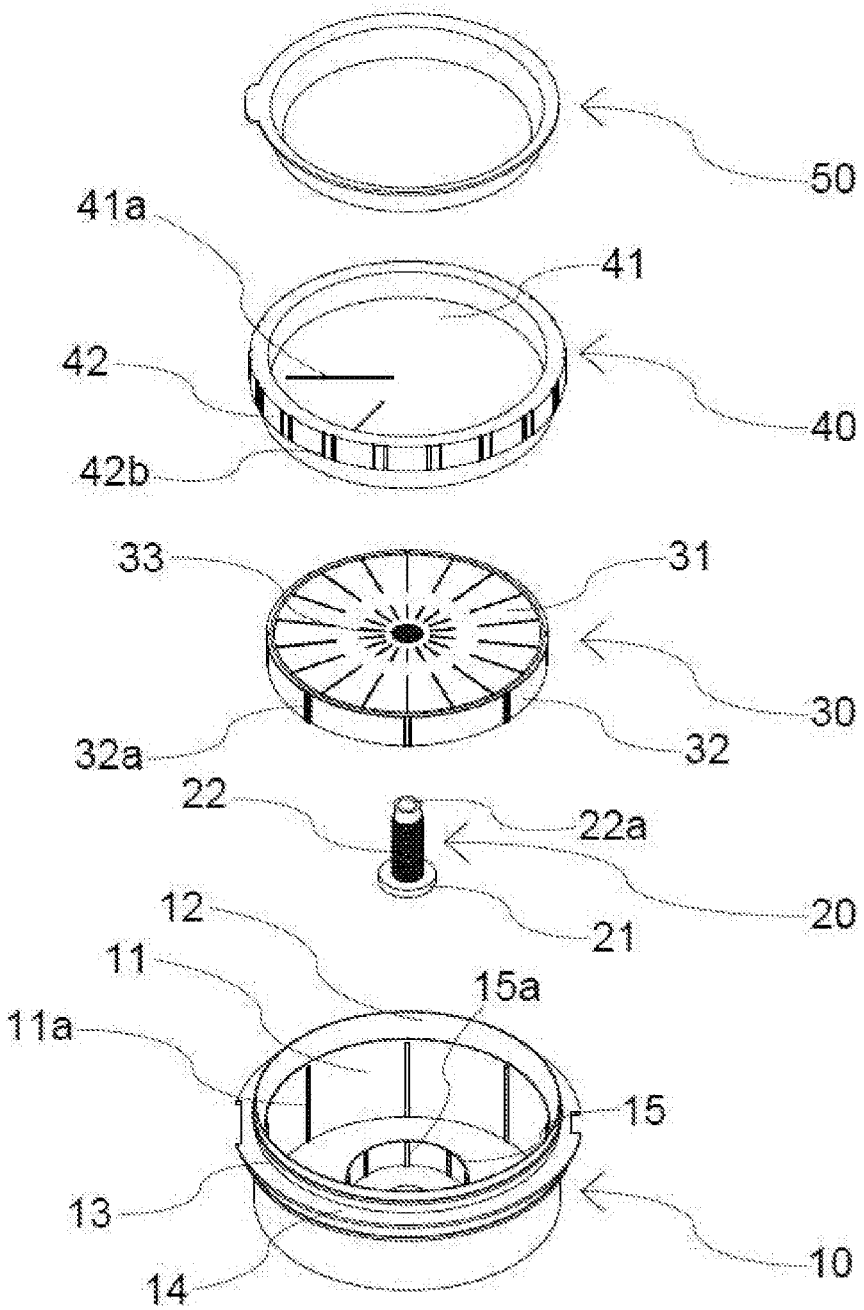
FIG. 4 is an exploded perspective view of the solid cosmetic container according to an embodiment of the present invention.
Figure 5:
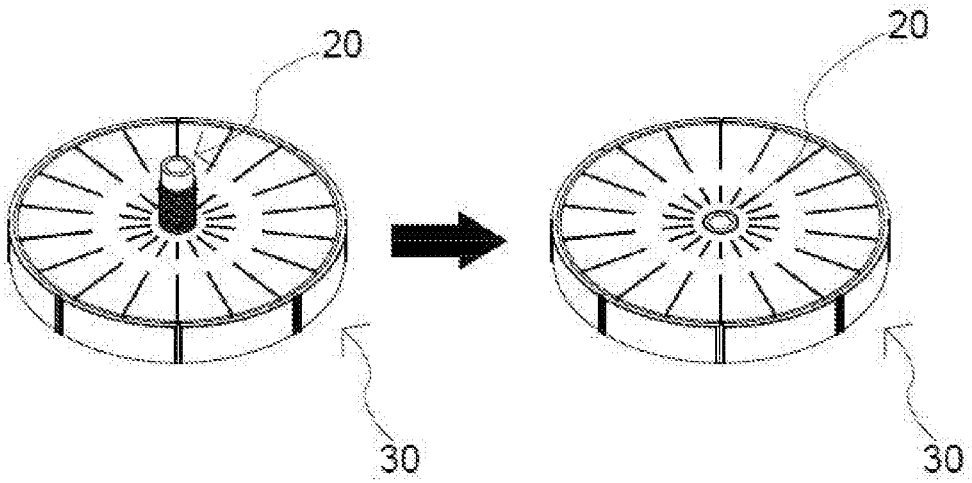
FIG. 5 is an operation view of a plate shaft and a cosmetic material plate according to an embodiment of the present invention.
Figure 6:
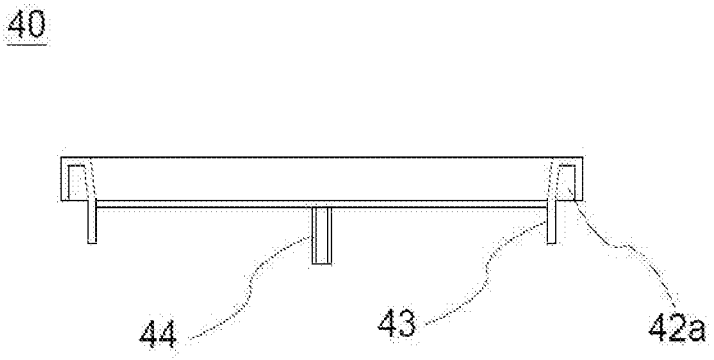
FIG. 6 is a cross-sectional view of a grinder according to an embodiment of the present invention.
Figure 7A:
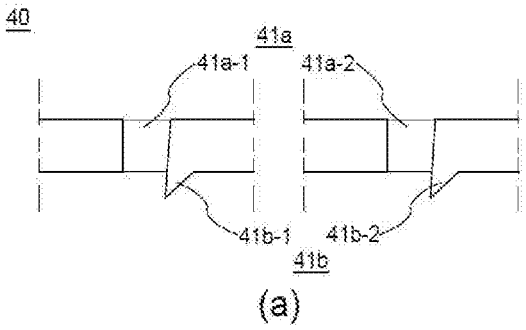
FIG. 7A is a partial cross-sectional view of a grinder having a discharge groove and a cutting blade which is inclined so that a downward end has a predetermined inclination according to an embodiment of the present invention.
Figure 7B:
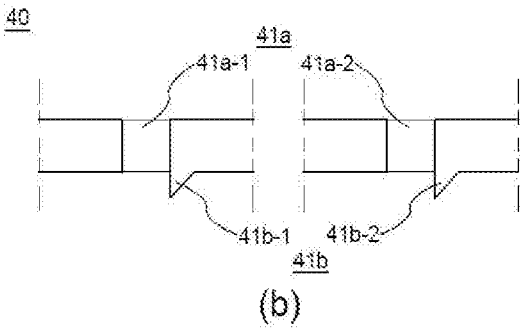
FIG. 7B is a partial cross-sectional view of a grinder including a discharge groove and a cutting blade having a right triangle shape of which a downward end extends vertically and has an angle of 45°.
Figure 8:
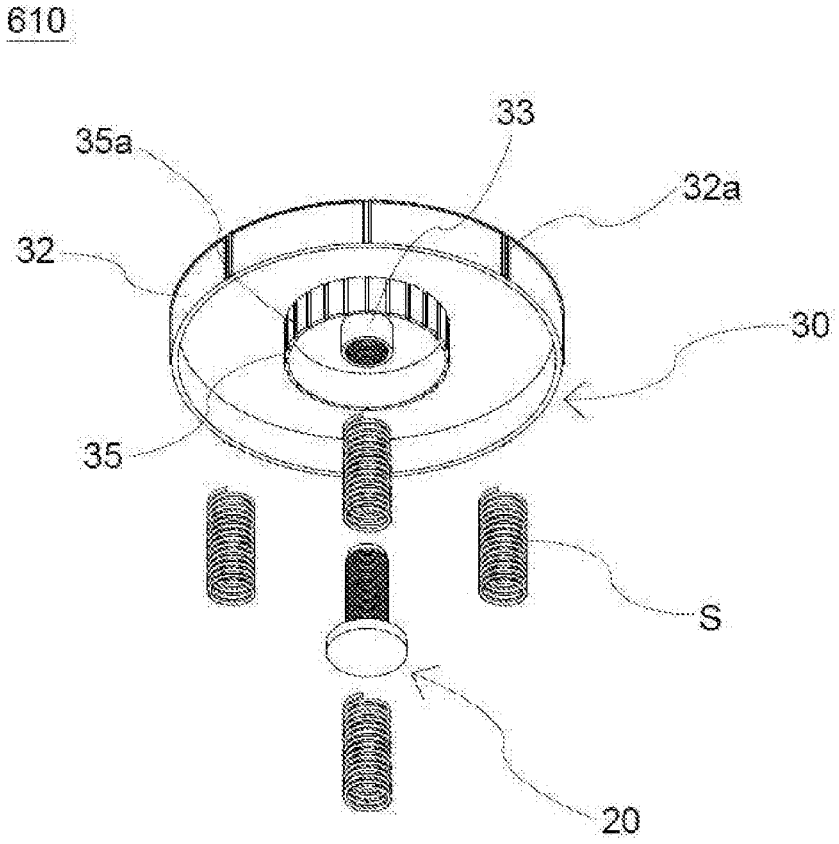
FIG. 8 is a view illustrating an equilibrium maintaining means according to an embodiment of the present invention.
Figure 9:
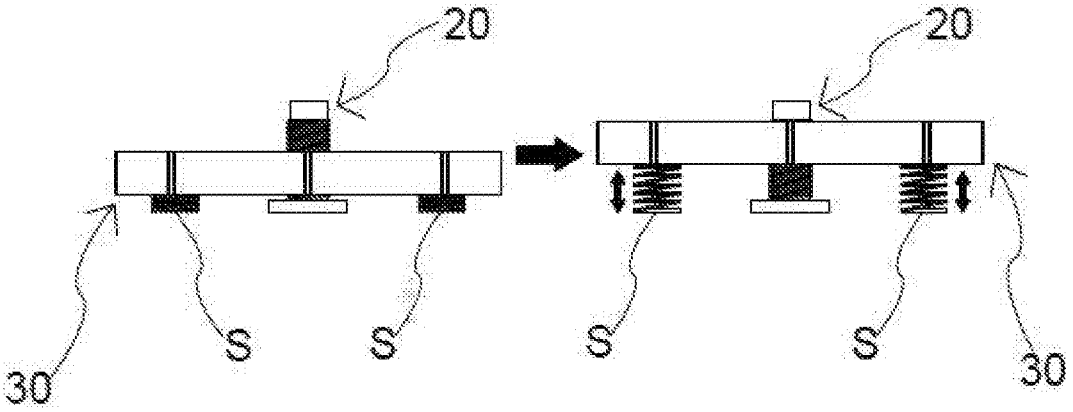
FIG. 9 is an operation view of the equilibrium maintaining means according to the embodiment of the present invention.
Figure 10:
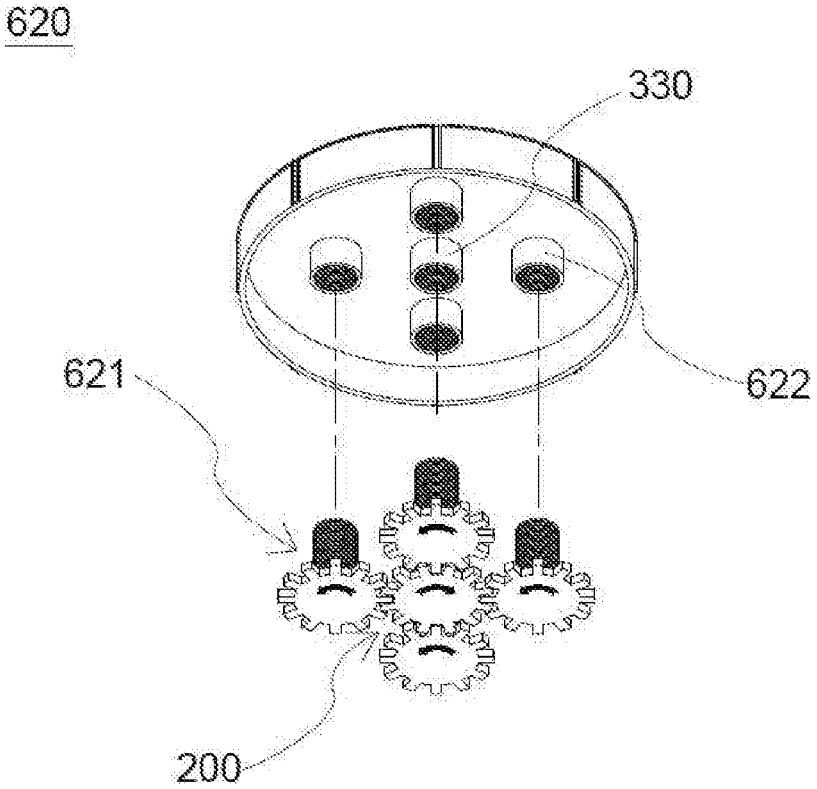
FIG. 10 is a view illustrating an equilibrium maintaining means according to another embodiment of the present invention.
Figure 11:
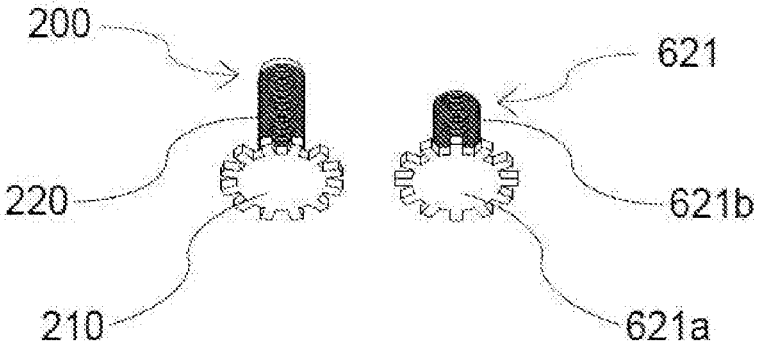
FIG. 11 is a view illustrating a plate shaft and a gear rod of the equilibrium maintaining means according to another embodiment of the present invention.

FIG. 1 is a flowchart illustrating a method of shaping a solid cosmetic material according to an embodiment of the present invention, FIG. 2 is a view illustrating a filling guide member and a cosmetic material shaping method according to an embodiment of the present invention, FIG. 3 is a plan view illustrating a cosmetic container on which the solid cosmetic material is seated according to an embodiment of the present invention, FIG. 4 is an exploded perspective view of the solid cosmetic container according to an embodiment of the present invention, FIG. 5 is an operation view of a plate shaft and a cosmetic material plate according to an embodiment of the present invention, FIG. 6 is a cross-sectional view of a grinder according to an embodiment of the present invention, FIG. 7A is a partial cross-sectional view of a grinder having a discharge groove and a cutting blade which is inclined so that a downward end has a predetermined inclination according to an embodiment of the present invention, and FIG. 7B is a partial cross-sectional view of a grinder including a discharge groove and a cutting blade having a right triangle shape of which a downward end extends vertically and has an angle of 45°, FIG. 8 is a view illustrating an equilibrium maintaining means according to an embodiment of the present invention, FIG. 9 is an operation view of the equilibrium maintaining means according to the embodiment of the present invention, FIG. 10 is a view illustrating an equilibrium maintaining means according to another embodiment of the present invention, and FIG. 11 is a view illustrating a plate shaft and a gear rod of the equilibrium maintaining means according to another embodiment of the present invention.

According to the present invention, a method of filling a cosmetic material p in a cosmetic inner container 10 of the cosmetic container and solidifying and shaping the cosmetic material p is performed according to the following steps.

(A1) Step Preparing Cosmetic Material

As the cosmetic material p, a powder cosmetic material, a melted liquid cosmetic material having wax, or the like is prepared.

In a step of shaping the cosmetic material, powder cosmetic material or a liquid cosmetic material having wax fills the cosmetic container and is solidified. The solid cosmetic material is obtained by compressing the powder or kneading and solidifying the powder, or the solid cosmetic material is obtained by filling the liquid cosmetic material having wax and solidifying the liquid cosmetic material.

(A2) Step of Preparing Cosmetic Inner Container to which Cosmetic Material is to be Inputted.

A configuration of the cosmetic container according to the present invention which is filled with the cosmetic material and in which the cosmetic material is solidified is as follows.

The solid cosmetic container includes a cosmetic inner container 10, a plate shaft 20 which is placed on an inner bottom surface of the cosmetic inner container 10, a cosmetic material plate 30 which is coupled to the plate shaft 20 and on which a cosmetic material p is seated; and a grinder 40 which rotates the plate shaft 20, is coupled to the cosmetic material plate 30 so that the cosmetic material plate 30 moves in an up-down direction, and is placed to cut an upper surface of the cosmetic material p while being rotated.

The cosmetic inner container 10 is formed to include an accommodation portion of which an upper portion is open and in which the cosmetic material p is accommodated, and include a side surface having a first side surface 11 and a second side surface 12 which are sequentially separated at a predetermined interval from an inside toward an outside with a step. An annular protrusion 13 is formed on an outer upper edge of the second side surface 12, and a flange-shaped pedestal 14 is provided at a predetermined position of a lower portion of the annular protrusion 13.

Moreover, a plurality of first protrusion guides 11*a* are formed on an inner surface of the first side surface 11 of the cosmetic inner container 10 so as to protrude in the up-down direction. The plurality of first protrusion guides 11*a* guide the cosmetic material plate 30 coupled to the plate shaft 20 described later such that the cosmetic material plate 30 does not rotate and moves only in the up-down direction.

Moreover, a guide wall 15 having a predetermined height may be formed to have a predetermined inner dimeter at a center of a bottom surface of the accommodation portion, and a second protrusion guide 15*a* may be formed on the inner surface of a guide wall 15 in the up-down direction.

The plate shaft 20 is placed on the inner bottom surface of the cosmetic inner container 10, and includes a rotary plate 21 having a predetermined size and a rotary rod 22 which is formed integrally with the rotary plate 21 vertically. The rotary rod 22 includes a rod penetrating hole 22*a* which has a polygonal cross section and extends in the up-down direction. A shaft 44 of a grinder describe later is fitted to the rod penetrating hole 22*a* such that the plate shaft 20 is rotated by the rotation of the grinder 40.

Moreover, threads are formed on an outer surface of the rotary rod 22 of the plate shaft 20.

The cosmetic material plate 30 is screwed to the plate shaft 20 and is moved up or down by the rotation of the plate shaft 20, and the cosmetic material p is seated on the plate. The cosmetic material plate 30 includes a plate upper surface 31 on which the cosmetic material p is seated, a plate side surface 32 which is formed to be bent downward from an edge of the plate upper surface 31 and has a predetermined height, and a shaft coupling portion 33 which is formed downward to communicate with a coupling penetrating hole formed at a center of the plate upper surface 31 and has threads formed inside the shaft coupling portion 33.

The rotary rod 22 of the plate shaft 20 is screwed to the shaft coupling portion 33, and thus, the cosmetic material plate 30 performs a translational motion upward or downward by the rotary rod 22 which is rotated right or left by the rotation of the grinder 40.

A plurality of first guide grooves 32*a* which are restrained by the plurality of first protrusion guides 11*a* formed on the inner surface of the first side surface 11 of the cosmetic inner container 10 and are guided in the up-down direction are formed on an outer surface of the plate side surface 32, and the plurality of first guide grooves 32*a* are formed in the up-down direction so as to correspond to the plurality of first protrusion guides 11*a*.

Moreover, a guide groove wall 35 having a predetermined height with reference to the shaft coupling portion 33 may be annularly formed in a lower portion of the cosmetic material plate 30. The guide groove wall 35 distributes a load received by the plate upper surface 31 to increase a sustaining force. Moreover, a plurality of second guide grooves 35*a* which are restrained by the second protrusion guide 15*a* of the guide wall 15 formed on the bottom surface of the cosmetic inner container 10 and are guided in the up-down direction may be formed on an outer surface of the guide groove wall 35, and the plurality of second guide grooves 35*a* are formed in the up-down direction so as to correspond to the plurality of second protrusion guides 15*a*.

Here, preferably, an inner diameter of the guide groove wall 35 is slightly smaller or equal to an inner diameter of the guide wall 15 formed on the bottom surface of the cosmetic inner container 10, and heights of the guide groove wall 35 and the guide wall 15 are equal to a height of the plate side surface 32 of the cosmetic material plate 30.

According to the above-described configuration, an empty space between the bottom surface of the cosmetic inner container 10 and the cosmetic material plate 30 is prevented from increasing, and an upper space of the cosmetic material plate 30 on which the cosmetic material p is seated is prevented from relatively decreasing. Moreover, a center portion of the cosmetic material plate 30 is prevented from being bent downward by a load of the cosmetic material p seated on the cosmetic material plate 30, and thus, the first protrusion guide 11*a* formed on the plate side surface 32 is prevented from being deviated from the first guide groove 32*a* of the cosmetic inner container 10, screwing of the rotary rod 22 of the plate shaft 20 screwed to the shaft coupling portion 30 is prevented from being misaligned, and a vertical guide of the rotary rod 22 is prevented from being disturbed.

Moreover, the inner diameter of the guide groove wall 35 is larger than the diameter of the rotary plate 21 of the plate shaft 20, the rotary plate 21 is located in an inner diameter portion of the guide groove wall 35 before operation, and a location of a lower surface of the rotary plate 21 is equal to a location of a bottom portion of the guide groove wall 35 or is located above the location of the bottom portion.

According to the configuration of the cosmetic material plate 30, while the cosmetic material plate 30 is not rotated, the plate side surface 32 is restrained by the first protrusion guide 11*a* of the cosmetic inner container 10 so as to be guided in in the up-down direction. Moreover, the guide groove wall 35 formed on the lower portion of the plate upper surface 31 is restrained by the second protrusion guide 15*a* formed on the guide wall 15 of the cosmetic inner container 10 so as to be guided in the up-down direction, and thus, the cosmetic material p can be guided and moved in the up-down direction in a state of being stably seated.

The grinder 40 is connected to the plate shaft 20 so as to transmit a rotation force to the plate shaft 20 and rotate the plate shaft 20, moves the cosmetic material plate 30 in the up-down direction by the rotating plate shaft 20, and rotates according to the movement of the cosmetic material plate 30 in the up-down direction to cut the upper surface of the cosmetic material p and discharge the cosmetic material p to the outside. The grinder 40 includes a grinder upper surface 41 which is formed in a well shape having an edge protruding upward and a flat bottom and includes a plurality of discharge grooves 41*a* formed on a bottom surface, a grinder side surface 42 which is bent to have a predetermined height downward from the edge of the grinder upper surface 41 and includes an annular groove 42*a* formed on an outer surface edge, an annular sealing portion 43 which is formed to have a predetermined height and a predetermined inner diameter on a lower portion of the grinder upper surface 41, and a shaft 44 which is formed integrally with a lower surface at a center of a lower portion of the grinder 40 and has a polygonal cross section.

The discharge groove 41*a* formed on the bottom surface of the grinder upper surface 41 has a through slit shape which is formed to be narrow and long from the center to the edge based on a center axis of the bottom surface and a cutting blade 41*b* protruding to have a predetermined height along the discharge groove 41*a* is formed on a slit side of one side of a lower portion of each discharge groove 41*a*. The cutting blade 41*b* thinly cut the upper surface of the cosmetic material p according to the rotation of the grinder 40 and discharges the cut cosmetic material to the upper portion of the bottom surface through the discharge groove 41*a*.

In this case, a length of the discharge groove 41*a* may be larger than a radius of the cosmetic material seated on the cosmetic material plate 30. Accordingly, as described later, the cut or pulled cosmetic material is seated in an extra space C formed between the inner surface of the first side surface 11 of the cosmetic inner container 10 and the side surface of the cosmetic material p.

Here, as illustrated in FIG. 7A, a downward end of the cutting blade 41*b* may be obliquely formed to have a predetermined inclination in a forward direction so that the not only cut cosmetic material p is easily discharged to the upper side of the discharge groove 41*a*, but also a remaining amount of the cosmetic material which is cut but discharged is minimized. Moreover, as illustrated in FIG. 7B, the cutting blade 41*b* may have a right triangle shape of which a downward end extends vertically and has an angle of 45°.

In the present invention, in addition to those exemplified in the present invention, a shape and an angle of the downward end of the cutting blade 41*b* can be variously set to easily perform the rotation cutting. Accordingly, uneven scraping or imprinting of the cosmetic material is prevented, and thus, the cosmetic material is normally cut and discharged.

Moreover, one discharge groove 41*a* and one cutting blade 41*b* may be provided. In this case, the height of the cutting blade 41*b* may be changed according to a change of a shape such as the inclination of the downward end.

Moreover, a plurality of discharge grooves 41*a* and a plurality of cutting blades 41*b* may be provided. Here, a height of a first cutting blade 41*b*-1 formed in the first discharge groove 41*a*-1 may be equal to or may be different from a height of the second cutting blade 41*b*-2 formed in the second discharge groove 41*a*-2, and in this case, the second discharge groove 41*a*-2 may be used as an auxiliary means for discharging the cosmetic material p which is not discharged through the first discharge groove 41*a*-1.

In this case, the heights of the plurality of cutting blades may sequentially decrease or may be changed periodically. Accordingly, a user can economically use the cosmetic material.

That is, the height of the second cutting blade 41*b*-2 formed in the second discharge groove 41*a*-2 is formed to lower than the height of the first cutting blade 41*b*-1 formed in the first discharge groove 41*a*-1. Accordingly, an amount of the cosmetic material discharged to the second discharge groove 41*a*-2 by one rotation of the grinder 40 is smaller than an amount of the cosmetic material discharged to the first discharge groove 41*a*-1, and thus, the total amount of the cosmetic material discharged to the upper side of the grinder 40 can be adjusted, and as a result, the user can economically use the cosmetic material.

Of course, the heights of the plurality of cutting blades 41*b* may be variously changed uniformly or individually according to the change in the shape depending on the number of the discharge grooves 41*a* and the inclination of the downward end, the cutting blades 41*b*, an interval between the cutting blades 41*b*, or like. This is because the surface of the cosmetic material p raises as the cosmetic material plate 30 moves upward according to the rotation angle of the grinder 40.

Meanwhile, in order to discharge the cosmetic material cut by the cutting blade 41*b* through the discharge groove 41*a*, of course, the discharge groove 41*a* should be located in front of the cutting blade 41*b* in the rotation direction of the grinder 40.

Moreover, the annular sealing portion 43 is configured so that the inner diameter of the annular sealing portion 43 is equal to the outer diameter of the first side surface 11 of the cosmetic inner container 10. Accordingly, the annular sealing portion 43 is closely coupled to the outer side of the upper portion of the first side surface 11 while being located between the first side surface 11 of the cosmetic inner container 10 and the second side surface 12 and rotated so that the cosmetic material p accommodated in the inner surface of the first side surface 11 of the cosmetic inner container 10 is prevented from leaking to the outside.

Moreover, the shaft 44 is fitting-coupled to the rod penetrating hole 22*a* of the rotary rod 22 of the plate shaft 20 to restrain the rotary rod 22, and a cross-sectional shape of the shaft 44 is a polygonal shape which is the same as the shape of the cross section of the rod penetrating hole 22*a*. Accordingly, a rotating force of the shaft 44 is used to rotate the rotary rod 22 as it is.

Moreover, the annular groove 42*a* formed on an edge of the inner surface of the grinder side surface 42 is fitting-coupled to the annular protrusion 13 formed on an outside upper edge of the second side surface 12 of the cosmetic inner container 10, and thus, the grinder 40 rotates along a circumference relative to the cosmetic inner container 10 based on a common up-down center axis with respect to the rotating force applied to the grinder 40 from the outside.

A slip prevention portion 42*b* such as a protrusion or groove which prevents slip when the user grasps and rotates the grinder may be further provided on an outer surface of the grinder side surface 42.

Moreover, a sealing paper (not shown) which seals the discharge groove 41*a* may be further provided above a bottom surface of the grinder upper surface 41 on which the discharge groove 41*a* is formed.

Moreover, a lid-type puff pedestal 50 which is detachably opened or closed may be further provided on the upper surface of the grinder 40. The lid-type puff pedestal 50 prevents contamination of the cosmetic material p and the upper surface of the grinder 40 inside the cosmetic inner container 10 and separately stores the puff.

In addition, in the present invention, an equilibrium maintaining means may be further provided so that the cosmetic material plate 30 is prevented from rolling right or left about the center axis during the operation to maintain an equilibrium. By using the equilibrium maintain means, the upper surface of the cosmetic material p seated on the cosmetic material plate 30 is evenly cut, and thus, a desired amount of the cosmetic material is discharged.

The equilibrium maintain means may be provided between the lower surface of the cosmetic material plate 30 and the bottom surface of the cosmetic inner container 10, and may include a first equilibrium maintaining means 610 having a plurality of elastic bodies or a second equilibrium maintaining means 620 in which a plurality of gears are operated in conjunction with each other.

As illustrated in FIGS. 8 and 9, in the first equilibrium maintaining means 610, a plurality of compressed elastic bodies S are radially arranged by a predetermined distance based on the center axis of the cosmetic material plate 30, a front end of each elastic body S is restrained and fixed at a predetermined location of the lower surface of the cosmetic material plate 30, and a rear end of each elastic body S is restrained and fixed at a corresponding location of the bottom surface of the cosmetic inner container 10. In this case, elastic compression of each elastic body S is released when the cosmetic material plate 30 moves upward according to the rotation of the plate shaft 20, the elastic bodies S support the lower surface of the cosmetic material plate 30 moving upward, and thus, the rolling of the cosmetic material plate 30 is prevented.

Moreover, as illustrated in FIG. 10, the second equilibrium maintaining means 620 is constituted so that a plurality of gears 621 are operated in conjunction with each other. The second equilibrium maintaining means 620 includes a plate shaft 200 which includes a rotary plate 210 which is coupled to a shaft coupling portion 330 formed at a center of the cosmetic material plate 30 and has a tooth shape, and a rotary rod 220 which is formed to have an angle of 90° at a center of the rotary plate 210, a plurality of gears 621 which includes an interlocking rotary plate 621*a* which meshes with the rotary plate 210 of the plate shaft 200 so as to be rotated and has a tooth shape and an interlocking rotary rod 621*b* which is formed at an angle of 90° at a center of the interlocking rotary plate 621*a* and has an outer surface on which threads are formed, and a plurality of nut-type interlocking shaft coupling portions 622 which are formed downward at a predetermined position of a lower surface of the cosmetic material plate 30 and are screwed to the interlocking rotary rod 621*b*.

Here, the rotary rod 220 of the above-described plate shaft 200 is screwed to the shaft coupling portion 33 formed at the center of the cosmetic material plate 30, and the respective interlocking rotary rods 621*b* of the plurality of gears 621 are screwed to the plurality of interlocking shaft coupling portions 622. In this case, a thread direction of the rotary rod 220 is opposite to a thread direction of the interlocking rotary rod 621*b*, and according to this, a thread direction of the shaft coupling portion 33 is opposite to a thread direction of the interlocking shaft coupling portion 622. In order to provide a rotating force to the interlocking rotary plate 621*a* of the gear 621 with which the rotary plate 210 of the plate shaft 200 meshes while being rotated, a rotation direction of the rotary plate 210 and a rotation direction of the interlocking rotary plate 621*a* should be opposite to each other, and thus, the thread direction of the shaft coupling portion 33 should be opposite to the thread direction of the interlocking shaft coupling portion 622.

According to the configuration of the second equilibrium maintaining means 620, when the cosmetic material plate 30 performs a vertical translational motion upward or downward by the rotary rod 220 which is rotated right or left by the rotation of the grinder 40 and the interlocking rotary rod 621*b* which is rotated right or left in conjunction with the rotation of the rotary rod 220, the cosmetic material plate 30 does not tilt and roll to one side and can move upward or downward with an equilibrium.

That is, the plate shaft 200 and the plurality of gears 621 support the lower surface of the cosmetic material plate 30 moving in the up-down direction, and thus, an equilibrium of the cosmetic material plate 30 can be maintained.

In the configuration of the second equilibrium maintain means 620 according to the present invention, the guide wall 15 cannot be formed on the bottom surface of the cosmetic inner container 10. Accordingly, it is not necessary to form the guide groove wall 35 on the lower surface of the cosmetic material plate 30, and thus, it is not necessary to form the second protrusion guide 15*a* and the second guide groove 35*a*.

According to the equilibrium maintaining means, the cosmetic material p provided on the cosmetic material plate 30 is prevented from being cut asymmetrically.

In the present invention, as illustrated in the drawings, the cosmetic inner container 10 is formed in a circular shape in order to easily rotate the grinder 40. However, the shape of the cosmetic inner container 10 is not limited to the circular shape, and various shapes may be adopted as long as the grinder 40 can rotate.

(A3) Step of Placing Filling Guide Member 70 on Cosmetic Material Plate 30 Provided Inside Cosmetic Inner Container In order to filling the cosmetic material p in the cosmetic inner container 10 of the solid cosmetic container having the above-described configuration and shaping and solidifying the cosmetic material p, first, the plate shaft 20 is screwed to the cosmetic material plate 30 so that the rotary rod 22 protrudes above the center of the cosmetic material plate 30, and thereafter, the cosmetic material plate 30 coupled to the plate shaft 20 is placed on the bottom of the cosmetic inner container 10.

In this case, the plurality of first guide grooves 32*a* formed on the outer surface of the plate side surface 32 of the cosmetic material plate 30 are restrained by the plurality of first protrusion guides 11*a* formed on the inner surface of the first side surface 11 of the cosmetic inner container 10 so as to be coupled to the plurality of first protrusion guides 11*a*.

Thereafter, the filling guide member 70 having the vertical through-hole is placed so that the upper edge of the cosmetic material plate 30 comes into close contact with the inner surface of the first side surface 11 of the cosmetic inner container 10.

Here, the filling guide member 70 has a hollow tubular shape in which a flange is formed on an outer side of an upper portion and has a diameter so as to come into close contact with the inner surface of the cosmetic inner container 10.

In this case, the inner surface of the filling guide member 70 may be treated using an anodizing method (a work process in which an oxide film is formed on the surface of a workpiece by oxidizing the workpiece manufactured in a diluted oxide solution using + and − poles). Accordingly, when the filling guide member 70 is removed after the filling of the cosmetic material p is completed, the cosmetic material p does not adhere the filling guide member 70 and the filling guide member 70 is easily separated. In addition, in order to prevent the cosmetic material p from adhering to the filling guide member 70, a silicon release agent or the like may be applied to the inner surface of the filling guide member 70.

In this way, the filling guide member 70 can be prevented from adhering to the inner surface of the cosmetic inner container 10 in a process in which the cosmetic material p is solidified, and the extra space having a predetermined diameter is formed between the inner surface of the cosmetic inner container 10 and the side surface of the cosmetic material p.

In the present invention, only the case where the filling guide member 70 has a hollow cylindrical shape is described. However, the present invention is not limited to this. That is, a concentric cylindrical shape 70*a* in which a tubular cylinder having a smaller diameter is provided inside a hollow cylinder, a bisecting shape 70*b* in which a partition is provided inside a hollow cylindrical shape to bisect a space, and an n equal shape obtained by dividing a space into n equally may be provided to fill the space with the cosmetic materials p having different shapes or different types.

(A4) Step of Filling Cosmetic Material in the Filling Guide Member 70 and Solidifying Cosmetic Material The through hole of the filling guide member 70 is filled with a powder or melted liquid cosmetic material p, and the cosmetic material p is cooled to be solidified.

By using the filling guide member 70 in the process of filling and solidifying the cosmetic material p, the powder or melted liquid cosmetic material p is prevented from being solidified in a state of coming into close contact with the inner surface of the first side surface 11 of the cosmetic inner container 10 and the plurality of first protrusion guide 11*a* formed on the inner surface.

If the cosmetic material p is solidified in a state of coming into close contact with the inner surface of the first side surface 11 of the cosmetic inner container 10 and the plurality of first protrusion guide 11*a* formed on the inner surface, it is apparent that the first guide groove 32*a* of the cosmetic material plate 30 is difficult to be guided along the first protrusion guide 11*a* in the up-down direction.

(A5) Step of Removing the Filling Guide Member 70 and Forming Extra Space Between Inner Surface of Cosmetic Inner Container and Side Surface of Solidified Cosmetic Material After the cosmetic material p is solidified, the filling guide member 70 is removed, and the extra space C equal to a thickness of the filling guide member 70 between the inner surface of the first side surface 11 of the cosmetic inner container 10 and the side surface of the cosmetic material p is formed.

Due to the extra space C, the side surface of the cosmetic material p does not come into contact with the inner surface of the first side surface 11 of the cosmetic inner container 10 and the plurality of first protrusion guides 11*a* formed on the inner surface, and thus, the first guide groove 32*a* of the cosmetic material plate 30 can be smoothly guided along the first protrusion guide 11*a* in the up-down direction.

Moreover, the cosmetic material pushed during cutting of the upper surface of the cosmetic material p or the cosmetic material pushed by a flat bottom surface of a grinder 40 may drop and be seated in the extra space C having a predetermined diameter formed between the inner surface of the first side surface 11 of the cosmetic inner container 10 and the side surface of the cosmetic material p.

That is, while the upper surface of the cosmetic material p is cut according to the rotation of the grinder 40, a portion of the cosmetic material cut at the edge of the upper surface of the cosmetic material p is discharged, and a portion thereof may drop and be seated.

Moreover, while a predetermined portion of the upper surface of the cosmetic material p is cut by the cutting blade 41*b* of the rotating grinder 40, a height difference is generated between the cut upper surface and the upper surface which is not cut, and the upper surface of the cosmetic material p which is not cut is subjected to a compressive force by the bottom surface of the rotating grinder 40 and is pushed. In this case, a portion of the pushed cosmetic material drops and is seated in the extra space C, and thus, the smooth upper surface of the cosmetic material p can be maintained.

According to the above-described processes, if the step of shaping the solid cosmetic material in the cosmetic container ends, the grinder 40 is coupled to the upper portion of the cosmetic inner container 10, the grinder 40 is fitting-coupled to the rotary rod 22 of the plate shaft 20, and the bottom surface of the grinder 40 is placed on the upper surface of the cosmetic material p.

Meanwhile, in the present invention, the case where the filling and solidifying of the cosmetic material p are performed inside the inner container 10 is described. However, the filling and solidifying of the cosmetic material p may be performed outside the inner container 10 according to a structure of the upper surface of the cosmetic material plate 30 and a coupling structure between the cosmetic material plate 30 and the filling guide member 70, and the cosmetic material plate 30 on which the cosmetic material p is seated may move into the inner container 10.

Hereinafter, a process of operating the solid cosmetic material container according to the present invention is as follows.

If the user grasps the side surface of the grinder 40 and rotates the side surface in one direction relative to the cosmetic inner container 10, the plate shaft 20 coupled to the grinder 40 is rotated.

As the plate shaft 20 rotates, the cosmetic material plate 30 screwed to the plate shaft 20 moves upward along the first protrusion guide 11*a* and/or the second protrusion guide 15*a* provided in the cosmetic inner container 10.

As the cosmetic material plate 30 moves upward, the cosmetic material p provided on the upper surface of the cosmetic material plate 30 also moves upward, he upper surface of the cosmetic material p which has moved upward is cut by the cutting blade 41*b* of the rotating grinder 40, and the cut cosmetic material p is discharged to the upper surface portion of the grinder 40 through the discharge groove 41*a*.

Although the present invention is described in connection with the above-mentioned preferred embodiments, various other modifications and variations are possible without departing from the spirit and scope of the invention, and all differences within the scope equivalent to the claims are included in the invention.

The invention claimed is:

1. A method of shaping a solid cosmetic material in a cosmetic container, the method comprising the steps of:

preparing a cosmetic inner container to which the cosmetic material is to be input;

placing a filling guide member on a cosmetic material plate provided inside the cosmetic inner container;

filling the cosmetic material in the filling guide member and solidifying the cosmetic material;

removing the filling guide member and forming an extra space equal to a thickness of the filling guide member between an inner surface of the cosmetic inner container and a side surface of the solidified cosmetic material, wherein the filling guide member has a hollow tubular shape in which a flange is formed on an outer side of an upper portion and has a diameter so as to come into close contact with the inner surface of the cosmetic inner container, and wherein in a process of cutting of the cosmetic material by a grinder, the cosmetic material pushed by a flat bottom surface of the grinder drops in the extra space and is seated.

2. The method of claim 1, wherein the placing the filling guide member including the steps of:

(b-1) screwing a plate shaft to the cosmetic material plate, (b-2) placing the cosmetic material plate coupled to the plate shaft on a bottom of the cosmetic inner container, and (b-3) placing the filling guide member so that an upper edge of the cosmetic material plate comes into close contact with the inner surface of the cosmetic inner container.

3. The method of claim 2, wherein the (b-2) step includes coupling at least one guide groove formed on an outer surface of the cosmetic material plate to a least one protrusion guide formed on the inner surface of the cosmetic inner container so that the guide groove is restrained by the protrusion guide.

4. The method of claim 1, wherein the filling guide member has an inner surface which comes into contact with the cosmetic material and is anodized or is treated with a silicon release agent.

5. The method of claim 1, wherein a grinder is coupled to an upper portion of the cosmetic inner container, the grinder is fitting-coupled to a plate shaft, and a bottom surface of the grinder is placed on an upper surface of the cosmetic material.

6. A cosmetic container which is filled with the shaped cosmetic material according to claim 1, the cosmetic container comprising:

the cosmetic inner container;

a plate shaft which is placed on an inner bottom surface of the cosmetic inner container;

the cosmetic material plate which is coupled to the plate shaft and on which a cosmetic material is seated; and the grinder which rotates the plate shaft, is coupled to the cosmetic material plate so that the cosmetic material plate moves in an up-down direction, and is placed to cut an upper surface of the cosmetic material while being rotated.

7. The cosmetic container according to claim 6, wherein the cosmetic inner container is formed to include an accommodation portion of which an upper portion is open and in which the cosmetic material is accommodated, and includes a side surface having a first side surface and a second side surface which are sequentially separated at a predetermined interval from an inside toward an outside with a step.

8. The cosmetic container according to claim 7, wherein a plurality of first protrusion guides are formed on an inner surface of the first side surface so as to protrude in the up-down direction.

9. The cosmetic container according to claim 7, a guide wall having a predetermined height is formed to have a predetermined inner diameter at a center of a bottom surface of the accommodation portion, and a second protrusion guide is formed on an inner surface of the guide wall in the up-down direction.

10. The cosmetic container according to claim 6, wherein the plate shaft includes a rotary plate having a predetermined size and a rotary rod which is vertically formed integrally with the rotary plate at a center of the rotary plate.

11. The cosmetic container according to claim 10, wherein the rotary rod includes a rod penetrating hole which has a polygonal cross section and is formed in the up-down direction.

12. The cosmetic container according to claim 11, wherein a shaft of the grinder is fitted into the rod penetrating hole such that the plate shaft is rotated by the rotation of the grinder.

13. The cosmetic container according to claim 10, wherein threads are formed on an outer surface of the rotary rod.

14. The cosmetic container according to claim 6, wherein the cosmetic material plate includes:

a plate upper surface on which the cosmetic material is seated, a plate side surface which is formed to be bent downward from an edge of the plate upper surface and has a predetermined height, and a shaft coupling portion which is formed downward to communicate with a coupling penetrating hole formed at a center of the plate upper surface and has threads formed inside the shaft coupling portion.

15. The cosmetic container according to claim 14, wherein the shaft coupling portion is screwed to a rotary rod of the plate shaft.

16. The cosmetic container according to claim 14, wherein the plate side surface includes a plurality of first guide grooves which are restrained by first protrusion guides of the cosmetic inner container and are guided in the up-down direction.

17. The cosmetic container according to claim 16, wherein a guide groove wall having a predetermined height is annularly formed on a lower portion of the cosmetic material plate, and a plurality of second guide grooves are formed on an outer surface of the guide groove wall in the up-down direction.

18. The cosmetic container according to claim 17, wherein an inner diameter of the guide groove wall is less than or equal to an inner diameter of a guide wall formed on a bottom surface of the cosmetic inner container.

19. The cosmetic container according to claim 17, wherein a height of the guide groove wall is equal to a height of a plate side surface of the cosmetic material plate.

20. The cosmetic container according to claim 17, wherein an inner diameter of the guide groove wall is larger than a diameter of a rotary plate of the plate shaft.

21. The cosmetic container according to claim 6, wherein the grinder includes a grinder upper surface which is formed in a well shape having an edge protruding upward and a flat bottom and includes a plurality of discharge grooves formed on a bottom surface, a grinder side surface which is bent to have a predetermined height downward from the edge of the grinder upper surface and includes an annular groove formed on an outer surface edge, an annular sealing portion which is formed to have a predetermined height and a predetermined inner diameter on a lower portion of the grinder upper surface, and a shaft which is formed integrally with a lower surface at a center of a lower portion of the grinder and has a polygonal cross section.

22. The cosmetic container according to claim 21, wherein a cutting blade protruding to have a predetermined height along at least one of the discharge grooves is formed on a slit side of one side of a lower portion of the discharge groove.

23. The cosmetic container according to claim 21, wherein a length of the discharge groove is larger than a radius of the cosmetic material seated on the cosmetic material plate.

24. The cosmetic container according to claim 22, at least one of the discharge grooves is located in front of the cutting blade in a rotation direction of the grinder so that the cut cosmetic material is discharged.

25. The cosmetic container according to claim 21, wherein at least one discharge groove is provided, and sizes or intervals of the discharge grooves are equal to each other or are different from each other.

26. The cosmetic container according to claim 22, wherein at least one cutting blade is provided, and size or intervals the cutting blades are equal to each other or are different from each other.

27. The cosmetic container according to claim 22, wherein the cutting blade is obliquely formed so that a downward end of the cutting blade has a predetermined forward inclination.

28. The cosmetic container according to claim 22, wherein the cutting blade has a right triangle shape of which a downward end extends vertically and has an angle of 45°.

29. The cosmetic container according to claim 21, wherein an annular groove is formed on an inner surface edge of the grinder side surface and is fitting-coupled to an annular protrusion which is formed on an outer upper edge of a second side surface of the cosmetic inner container.

30. The cosmetic container according to claim 6, further comprising an equilibrium maintaining means for maintaining an equilibrium of the cosmetic material plate.

31. The cosmetic container according to claim 30, wherein the equilibrium maintaining means is a first equilibrium maintaining means in which a plurality of compressed elastic bodies are radially arranged at a predetermined distance with respect to a central axis of the cosmetic material plate.

32. The cosmetic container according to claim 31, wherein in the first equilibrium maintaining means, a front end of each elastic body is fixed to be restrained at a predetermined position of a lower surface of the cosmetic material plate, and a rear end of each elastic body is fixed to be restrained at a position corresponding to a bottom surface of the cosmetic inner container.

33. The cosmetic container according to claim 30, wherein the equilibrium maintaining means is a second equilibrium maintaining means in which a plurality of gears are operated in conjunction with each other.

34. The cosmetic container according to claim 33, wherein the second equilibrium maintaining means includes:

a plate shaft which includes a rotary plate which is coupled to a shaft coupling portion formed at a center of the cosmetic material plate and has a tooth shape, and a rotary rod which is formed to have an angle of 90° at a center of the rotary plate, a plurality of gears which includes an interlocking rotary plate which meshes with the rotary plate so as to be rotated and has a tooth shape and an interlocking rotary rod which is formed at an angle of 90° at a center of the interlocking rotary plate and has an outer surface on which threads are formed, and a plurality of nut-type interlocking shaft coupling portions which are formed downward at a predetermined position of a lower surface of the cosmetic material plate and are screwed to the interlocking rotary rod.

* * * * *